United States Patent [19]

Steinberger

[11] 4,094,379

[45] June 13, 1978

[54] SOUND-ABSORPTION PANEL

[75] Inventor: David I. Steinberger, Columbus, Ohio

[73] Assignee: Body Guard Inc., Columbus, Ohio

[21] Appl. No.: 722,358

[22] Filed: Sep. 13, 1976

[51] Int. Cl.[2] ..... G10K 11/04; E04B 1/99

[52] U.S. Cl. ..... 181/284; 181/210; 181/286; 181/295; 52/144

[58] Field of Search ..... 181/33 G, 33 HE, 33 GD, 181/33 GB, 33 C, 33 D, 33 K, 33 L, 33 R, 30, 42, 210, 284, 295, 203, 287, 286, 200; 52/144

[56] References Cited

U.S. PATENT DOCUMENTS

| | | | |
|---|---|---|---|
| 2,769,211 | 11/1956 | Hewitt | 181/33 G |
| 3,049,190 | 8/1962 | Coffman | 181/30 |
| 3,068,956 | 12/1962 | Cooley | 181/33 G |
| 3,382,947 | 5/1968 | Biggs | 181/33 G |

FOREIGN PATENT DOCUMENTS

| | | | |
|---|---|---|---|
| 598,854 | 5/1960 | Canada | 181/33 GD |

*Primary Examiner*—Stephen J. Tomsky
*Attorney, Agent, or Firm*—Wm. V. Miller

[57] ABSTRACT

A sound barrier and sound-absorption panel preferably of a transparent nature so as not to interfere with vision of and light for the machine or other noise-emitting device, to be shielded or enclosed by one or more of the panels. The panel is formed of transparent sound-reflecting material and sound-absorbing material so arranged relatively that the sound waves are received by the panel and deflected into the sound-absorbing material. The reflecting material and sound-absorbing material are arranged to provide one or more sound-receiving pockets or cavities each of which has an outwardly-diverging sound-reflecting wall surface which faces toward the sound-emitter. The sound-absorbing material is in the form of an outwardly-extending member so located in the pocket or cavity as to absorb sound waves which are received in the pocket or cavity and are deflected into the sound-absorbing member by the sound-reflecting wall surface.

11 Claims, 10 Drawing Figures

SOUND-ABSORPTION PANEL

BACKGROUND OF THE INVENTION

It is now customary to provide entire complete enclosures around machines or equipment which emit excessive noise. These enclosures must include barrier walls and ceilings which, when assembled, not only have the necessary sound-absorbing insulating materials incorporated therewithin but also have the necessary structural strength. They ordinarily include expensive insulating materials which are difficult to handle and to incorporate into the walls and which tend to deteriorate with age. The result is that these enclosures are expensive to build and maintain and another of the difficulties of their use is that lighting systems must also be incorporated in the enclosure for observance of the equipment from within the enclosure and still another is that the equipment usually cannot be observed from outside the enclosure without incorporating expensive insulated windows or other observation panels.

SUMMARY OF THE INVENTION

The present invention overcomes the above-indicated disadvantages by providing a simple, inexpensive panel which will receive sound waves and efficiently and effectively stop and absorb them. The panel will be a structural member itself, either as a free-standing vertical partition panel or as a self-supporting horizontal partition panel, such as a ceiling panel. The panels will usually be so arranged as to enclose the noise-emitting equipment, serve as a barrier to noise emitted thereby, and serve also as a barrier to noise originating outside the enclosure. The panels of the enclosure, with their absorbing material inwardly, serve to absorb noise within the enclosure, avoiding reverberation which would otherwise increase the amount of noise escaping the enclosure. Each panel preferably includes transparent walls to permit observance.

The term "diaphanous" is used hereinafter to include walls of the panel which are optically-transmissive and are either transparent or translucent, readily from the exterior of the enclosure as well as to permit the lighting of the equipment from a source exterior of the enclosure. This may be extremely important if the equipment is such that sparks from lighting accessories might present a fire-hazard. In such cases, it may be desirable to have the panel only translucent rather than transparent.

The panel, according to this invention, is formed of sound-reflecting material and sound-absorbing material so arranged relatively that the sound waves are received by the panel and deflected into the sound-absorbing material. The deflecting material is of high acoustic impedance compared to air, being of high density or rigidity, or both, and is preferably diaphanous, usually transparent. The sound-absorber is a body of material wherein sound waves are rapidly attenuated with little reflection or transmission and is frequently opaque. The two materials are arranged relatively to provide one or more sound-receiving pockets or cavities opening toward the sound-emitter. Each pocket will have a body of sound-absorbing material extending outwardly in the direction of the sound-emitter, and a wall of the sound-deflecting material extending angularly outwardly, at an acute angle, in a diverging relationship to the sound-absorbing body, resulting in space between the body and wall to permit vision or light-passage through the panel. The sound-deflecting wall will receive the sound waves and deflect them into the sound-absorbing body so that they are entirely absorbed, dampened scattered, or attenuated.

BRIEF DESCRIPTION OF THE DRAWINGS

The best mode contemplated in carrying out this invention is illustrated in the accompanying drawings in which.

DETAILED DESCRIPTION OF THE INVENTION

With specific reference to the drawings, various examples of this invention are indicated but it is to be understood that the invention may be embodied in many other forms. Also, some applications of the invention are shown or indicated but it is to be understood that these are not limiting as the invention is capable of immeasurable uses.

Figure 1:
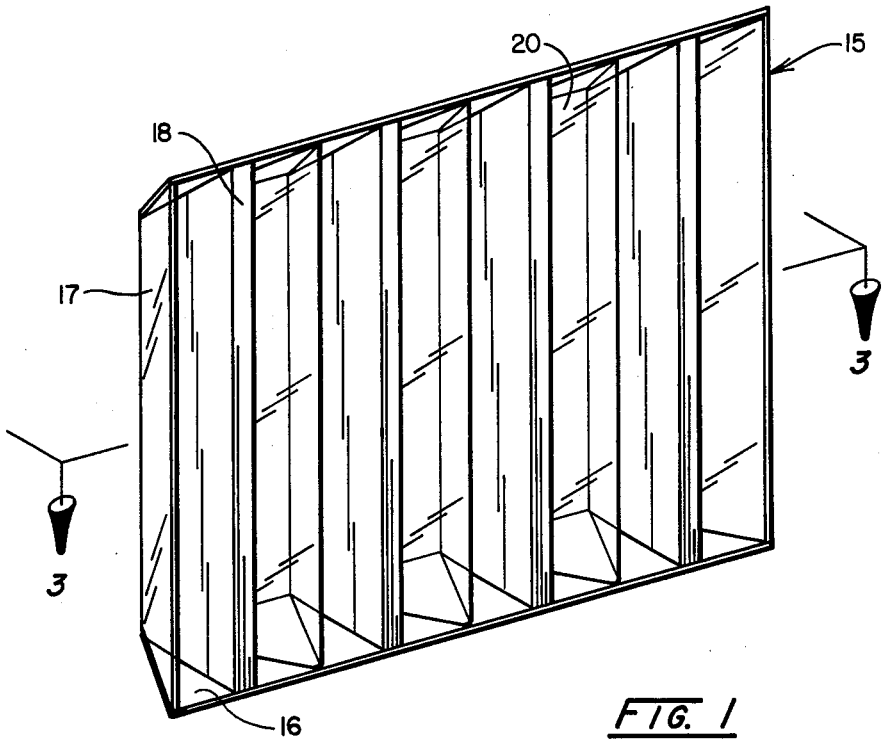
FIG. 1 is a perspective view of a sound-absorption panel embodying this invention.
Figure 2:
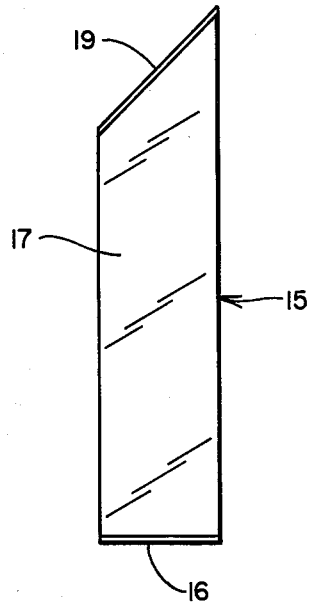
FIG. 2 is an end elevational view of the panel of FIG. 1.
Figure 3:
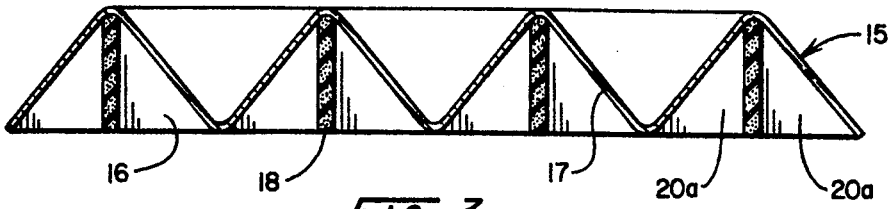
FIG. 3 is a horizontal sectional view taken along line 3—3 of FIG. 1.

The invention is shown in FIGS. 1 to 3 as being embodied in a free-standing panel 15 which is formed mainly of transparent rigid plastic material, such as Lucite, so that it is self-supporting. It includes a flat base wall 16 with upstanding walls 17 arranged to provide a series of vertical cavities 20 which open outwardly toward the machine or other noise-emitter. In each of these cavities there is a sound-absorbing body 18 which is vertically disposed co-extensive with the outwardly-diverging walls 17 of the cavity, shown at an angle of less than ninety degrees and bisecting the cavity to provide two sound-receiving pockets 20*a*. The body 18 may be of suitable low density sound-absorbing material, such as cellular material in the form of foamed plastic or sponge rubber, or it may be of fibrous or other materials having sound-absorbing voids or cavities, such as glass fiber insulation, etc. The body 18 in each cavity preferably extends the complete depth of the cavity, or forwardly and rearwardly, as indicated. At the top of the panel is a wall 19 which inclines downwardly or rearwardly and closes the upper ends of the cavities.

Figure 4:
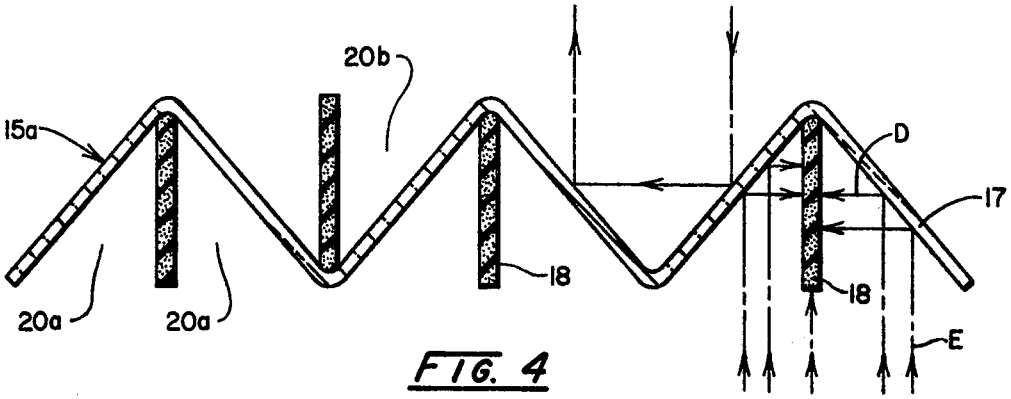
FIG. 4 is a view similar to FIG. 3 showing a modification of the panel.

The panel 15*a*, in FIG. 4, is exactly the same as the panel 15 of FIGS. 1 to 3 except that it receives and absorbs sounds at its opposite faces. It is provided with cavities 20*b* at its rear face in addition to the cavities 20 at its front face. The cavities 20 and 20b are shown extending the full height of the panel but they could be divided by horizontal walls. Also, one or more of the cavities 20b could be free of the sound absorbing body and merely reflect the sound in a predictable manner as indicated by the arrows at the cavity.

The manner in which each pocket 20a of each cavity functions is illustrated schematically in FIG. 4. The sound waves are indicated by arrows E in the pocket 20a to the right as coming from the sound-emitter or source. They strike the angular wall 17 and are deflected thereby, substantially as indicated by arrows D, into the sound-absorbing opaque body 18. Due to the nature of that body, the sound waves will be absorbed, dampened, or attenuated. Therefore, a plurality of these vertical cavities arranged side-by-side, as indicated, will be very effective. Since the walls 17 are transparent, vision through the panel is possible and also light will be transmitted through the panel, due to the arrangement of the bodies 18. These members 18 are preferably strips of low-density sound-absorbing material and this material is usually opaque. However, because they are arranged on edge relative to the depth of the cavities, that is with their edges extending toward the sound-emitter, they will not interfere substantially with vision or passage of light through the panel, substantial spaces or pockets being at each side thereof in the cavities. Thus, the body 18 will be a relatively narrow strip extending the complete height or longitudinal extent of the cavity and projecting outwardly in a plane substantially at a right angle to the general plane of the panel and toward the sound-emitter.

The sound-reflecting wall 17 and the sound-absorbing body or wall 18 must be disposed in diverging relationship. The included angle between them is less than 45°, an acute angle, and, in the examples shown, is approximately forty degrees. However, this angle can vary down to about twenty degrees depending on the frequency and direction of arrival of the sound waves to be reflected and absorbed. This will so dispose the wall 17 relative to the wall 18 that the sound waves will be received in the pocket 20a and be deflected by the wall 17 into the body or wall 18. This arrangement can provide repeated reflection of the sound waves causing them to pass through the sound-absorbing material more than once, when that material does not completely absorb those waves, especially for angles less than 45 degrees. This action provides sound absorption coefficiences for the assembly that are much higher than those for the sound absorption material 18 by itself.

Summaries of Test I and Test II appear at the end of this description and show the desirable properties of panels of the type shown in FIGS. 1 to 3. Test I shows the higher absorption coefficients, especially at 1000 Hz for the particular specimen of this invention tested. The overall rating for this specimen was 0.75. Test II shows that this specimen had a wall barrier rating of STC 26.

Figure 5:
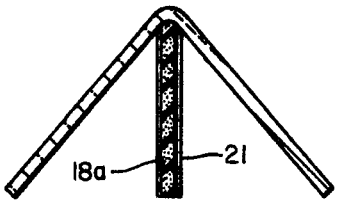
FIG. 5 is a horizontal sectional view through one of the sound-receiving pockets showing the sound-absorbing material enclosed in a protective film .

The example in FIG. 5 is the same as those described above except that the body 18a of sound-absorbing material is covered with a very thin film 21, preferably of plastic, to protect it from contamination. However, this film must be so thin as not to interfere with the sound-absorbing characteristics of the body. The covering will make it possible to provide a panel consisting of a plurality of the cavities and associated sound-absorbing bodies 18a, which can be made hygenic by washing-down with liquid detergents or the like.

Figure 6:
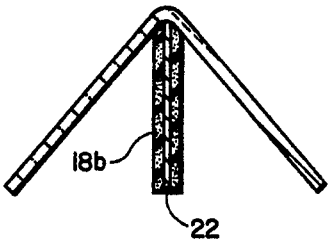
FIG. 6 is a similar view showing heat-absorbing material incorporated in the sound-absorbing material.

The example shown in FIG. 6 is an illustration of how heat-absorbing material may also be incorporated in the structure. Thus, the member 18b may consist of two laminations of sound-absorbing cellular material with a layer of heat-absorbing material 22 sandwiched therebetween. This may be a strip of lead or of plastic impregnated with particles of lead or other heat-absorbing substances.

Figure 7:
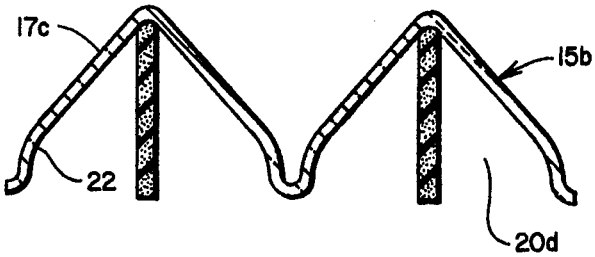
FIG. 7 is a horizontal sectional view showing the angular sound-reflecting walls with sound traps or recesses at their outer extremities.

The partial panel 15b, shown in FIG. 7, is the same as that shown in FIG. 1 except that the cavities 20d are formed of sound-deflecting walls 17c which are of somewhat different formation. In this instance, the outer extremities of the walls are curved or recessed to provide inwardly-facing grooves or channels 22 extending their full height or length. These grooves or channels will serve to more-effectively trap the sound waves as they enter the cavities 20d and deflect them into the sound-absorbing body 18d.

Any of the examples described above can be combined in multiples to form panels of suitable dimensions. Also, any number of panels may be combined to form suitable partitions or enclosures.

Figure 8:
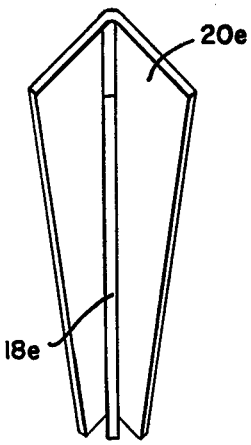
FIG. 8 is a perspective view showing a pocket similar to that used in the panel of FIG. 1 but of varying height from top to bottom.

The structure shown in FIG. 8 is similar to those previously described except that the cavity 20e is made of varying depth throughout its longitudinal extent or height and the sound-absorbing wall 18c is similarly formed. Thus, this structure, will have varying sound-deflecting and absorbing characteristics along its length which may be desirable for special installations. Any number of these structures may be combined into a panel.

Figure 9:
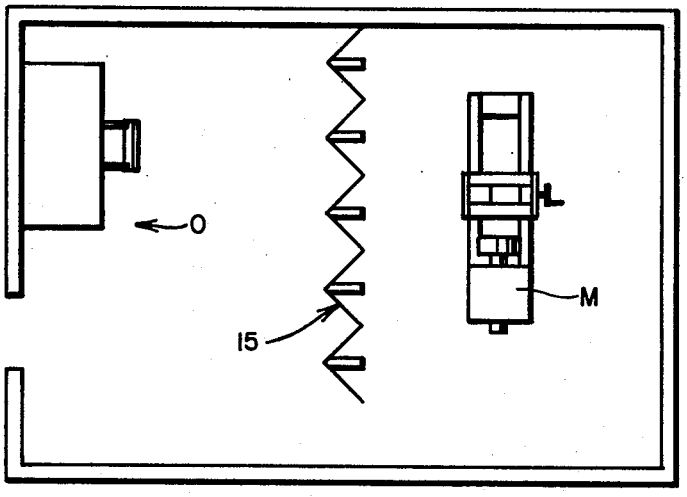
FIG. 9 is a schematic view illustrating the use of a panel, embodying this invention as a free-standing partition.

In the structure shown in FIG. 9, the sound-deflecting and absorbing structure is in the form of a transparent or translucent palstic sound reflector 17f, in the form of a pyramid, to provide a cavity 20f with its wide mouth outwardly toward the sound-emitter. Within this cavity, is disposed the sound-absorbing body 18f which is of reverse pyramidal form. The sound-deflecting walls of shell 17f and the corresponding walls of the body 18f will, therefore, be disposed at the desired acute angle and there will be space therebetween for passage of light and for vision, if a panel is made up of a number of these cavity members.

In each example of the invention described the sound-deflecting wall is a relatively hard smooth surface at a selected acute angle relative to the cooperating sound-absorbing wall, and the soft sound-absorbing wall is so disposed relative to the depth of the pocket or cavity as not to interfere with vision or light-transmission through the cavity formed of such walls.

As indicated, each of the panels made as described is a self-supporting structure which can be used as a vertical or horizontal partition or wall. Thus, in FIG. 9, the panel is shown as a free-standing vertical partition 15 to serve to absorb noise emitted by a machine M and prevent it from reaching the office area O. It would be desirable for this panel to be transparent so light could pass through it and the machine M could be observed from beyond the panel and it could be like the one shown in FIG. 1.

Figure 10:
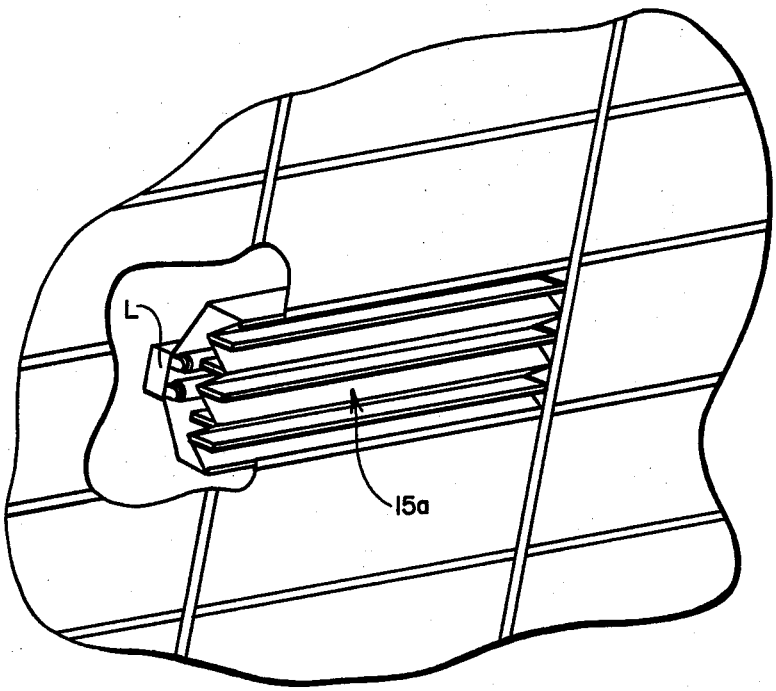
FIG. 10 is a schematic view illustrating the use of a panel, embodying this invention, as a ceiling panel.

In FIG. 10 the panel 15a is shown suspended in horizontal position with cavities facing upwardly toward a light L. In this case, the panel need only be translucent to permit light to pass downwardly and so as hide objects above the ceiling. Noise, both in the room below and ceiling and in the space above the ceiling, will be absorbed by this panel.

Any equipment may be completely enclosed with suitable arrangements of the structural panels of this invention to eliminate or substantially reduce noise emitted thereby. Each panel is formed of an assembly of various sound-deflecting or absorbing pockets of the type described above. Each pocket includes the outer body or shell of high-density, sound-deflecting walls and the inner body of low-density, sound-absorbing material, so arranged relatively that there is a cavity or pocket between the two bodies. The sound-deflecting shell has its open mouth directed toward the sound-emitter so as to effectively collect the sound waves emitted therefrom and the sound-absorbing body is also directed toward the sound emitter. Thus, the sound will be substantially absorbed, dampened, or attenuated.

TEST ONE

TEST METHOD

The test method conforms explicitly with the requirements of the American Society for Testing and Materials Method of Test for Sound Absorption of Acoustical Materials in Reverberation Rooms, ASTM Designation: C423-66. A description of the measuring technique is available separately.

DESCRIPTION OF THE SPECIMEN

The specimen was made up of 6 pieces of Clear and Quiet 48 inches (1.22 m) long by 33½ inches (0.85 m) wide and 2 pieces 48 inches (1.22 m) long by 8¼ inches (0.21 m) wide. It was made of 3/16 inch (4.76 mm) plastic corrugated, 8¼ inches (0.21 m) between corrugations and 5¼ inches (0.13 m) deep. A piece of 1 inch (25.4 mm) thick by 5 inches (0.13 m) wide foamed plastic was cemented vertically in the valley of each corrugation. The specimen weighed 1.86 pounds per sq ft (9.08 kg/m$^2$). The total area was 72 sq ft (6.69 m$^2$). Mounting No. 7 was used — (applied to suspension system with 16 inch spacing between face of material and hard backing).

PRECONDITIONING

The specimen is held at least 48 hours under the test conditions of 72° F (22° C) and 61% relative humidity.

| | TEST RESULTS ⅓ Octave Band Center Frequency, Hz | | | | | | |
|---|---|---|---|---|---|---|---|
| | 125 | 250 | 500 | 1000 | 2000 | 4000 | NRC |
| Absorption Coefficients | .32 | .39 | .64 | 1.10 | .86 | .92 | .75 |

Ninety percent confidence limits for measured coefficients are less than 0.03 at 125 Hz and less than 0.015 at higher frequencies. No adjustments were made in coefficient values. The noise reduction coefficient (NRC) is the average of the coefficients at 250, 500, 1000, and 2000 Hz, expressed to the nearest integral multiple of 0.05, or to 0.95, whichever is the lower.

Below is a comparison of absorption test results of the panel referenced to in "Test One" as compared to the manufacturer's test of its absorbent material.

| ⅓ Octave Band Center Frequency | One-inch "Pyrell" in Wall 18 of Panel | Manufacturer's Test Of Scott Acoustical Foam "Pyrell" UL-94 SE (1 inch) |
|---|---|---|
| 125 | .32 | .07 |
| 250 | .39 | .15 |
| 500 | .64 | .41 |
| 1000 | 1.10 | .76 |
| 2000 | .86 | .74 |
| 4000 | .92 | .70 |
| NRC* | .75 | .50 |

*0/0 noise reduction over standard frequency ranges. Note the significant increase in NRC (sound absorption, a fifty percent improvement) properties of the panel test configuration and its equivalent as compared to manufacturer's absorption specification.

TEST TWO

TEST METHOD

Unless otherwise designated, the measurements reported below were made with all facilities and procedures in explicit conformity with the American Society for Testing and Materials Designations E 90-70 and E413-73, as well as other pertinent standards.

DESCRIPTION OF THE SPECIMEN

The test specimen, 5 inches (127.0 mm) overall thickness, 48 inches (1.22 m) wide, and 96 inches (2.44 m) high, was mounted directly into the laboratory test opening and sealed in place at the entire perimeter. The specimen was constructed of 3/16 inch (4.76 mm) thick clear UVEX plastic formed into a pleated wall. The spacing was 8 inches (203.2 mm) between peaks of pleats and 6 inches (152.4 mm) down each valley. Each valley on one side contained Scott Acoustical Foam "Pyrell", UL-94, Se-1, 90P.P.I. strips, each 1 inch (25.4 mm) thick, 5½ inches (139.7 mm) deep, and the full 96 inches (2.44 m) long. The specimen weighed 65 pounds (29.5 kg), an average of 2.03 pounds per sq ft (9.91 kg/m$^2$). The transmission area, S, used in the computations was 32 sq ft (2.97 m$^2$). At the time of the measurement the test rooms had the following ambient conditions: source room 80° F (26.7° C) and 56% RH, receiving room 80° F (26.7° C) and 56% RH.

RESULTS OF MEASUREMENTS

Sound transmission loss values are tabulated at the eighteen standard frequencies. An explanation of the sound transmission class rating, a graphic presentation of the data, and additional information appear on the following pages.

| Frequency, Hertz (cps) | 100 | 125 | 160 | 200 | 250 | 315 | 400 | 500 | 630 | 800 | 1000 | 1250 | 1600 | 2000 | 2500 | 3150 | 4000 | 5000 |
|---|---|---|---|---|---|---|---|---|---|---|---|---|---|---|---|---|---|---|
| Transmission Loss, dB | 21 | 22 | 21 | 19 | 16 | 14 | 17 | 20 | 23 | 26 | 31 | 34 | 35 | 35 | 35 | 35 | 36 | 37 |
| Deficiencies | | | | | 3 | 8 | 8 | 6 | 4 | 2 | | | | | | | | |
| Sound Transmission Class 26 | | | | | | | | | | | | | | | | | | |

In each form of the panel, the sound-deflecting surface of the pocket diverges outwardly at an angle relative to the sound-absorbing surface of the pocket and extends along a straight line or plane which is at a selected angle relative to the straight line or plane of the absorbing surface of the pocket. This arrangement can provide repeated reflection of the sound waves, causing them to pass through the sound-absorbing material more than once, when the material does not completely absorb those waves, especially for the lesser angles.

The invention is a self-contained panel structure, that is, the structure itself has the full barrier properties of the reflecting material and yet the increased absorption properties over and above the basic properties of the sound-absorbing material itself. This structure is useful as a stand-alone unit and does not require another structure for support. Additionally, much less absorption material is used Furthermore, the structure does not substantially interfere with visibility or light-transmission.

Having thus described this invention what is claimed is:

1. A sound-absorbent structure comprising an outer shell of high-density sound-deflecting material forming a cavity with sound-deflecting walls and a mouth adapted to open toward the sound emitter, and a body of low-density sound-absorbent material disposed within the cavity and extending outwardly relative thereto in spaced relationship to the walls of said cavity; said sound-deflecting walls having inner plane surfaces diverging at an angle less than ninety degrees from an inner vertex, said sound-absorbent body being in the form of a strip of material having opposed plane surfaces and inner and outer edges with its inner edge at the vertex between said sound-deflecting walls and with its outer edge exposed at a position substantially outwardly thereof, said sound-absorbent strip bisecting said cavity formed by said diverging sound-deflecting walls to provide pockets at each side of said strip, each of said pockets having a plane sound-deflecting surface formed by one of said sound-deflecting walls and a plane absorbing surface adjacent thereto and on said sound-absorbing strip which are disposed relatively at an angle of less than 45°.

2. A sound-absorbent structure according to claim 1 in which the cavity is of varying depth throughout its length and the strip is of correspondingly varying depth.

3. A sound-absorbent structure according to claim 1 in which the sound-absorbing surface is covered by a thin protective film.

4. A sound-absorbent structure according to claim 1 in which the sound-absorbent strip has heat-absorbing material incorporated therein.

5. A sound-absorbent structure according to claim 1 in which each of said plane sound-deflecting surfaces has a recess along its outer extremity to trap sound waves and deflect them into the sound-absorbing surface.

6. A sound-absorbent structure according to claim 1 in which a pair of the pockets is formed in a cavity of substantially V-cross-section, formed by a pair of the sound-deflecting walls, said strip extending longitudinally substantially co-extensive with the sound-deflecting walls in the cavity and from the vertex thereof outwardly in the bisceting relationship to the cavity to form the two equal outwardly-opening longitudinally-extending pockets.

7. A combination sound-barrier and sound-absorbent panel formed from the structure of claim 1 including a plurality of the cavities disposed side-by-side and suitably joined together.

8. A panel according to claim 7 in which transverse wall members are provided at both ends of the cavities.

9. A panel according to claim 7 in which the sound-deflecting walls are of diophanous material.

10. A combination sound-barrier and sound-absorbent panel formed of a plurality of the structures of claim 1 assembled together with their respective cavities in side-by-side parallel relationship.

11. A panel according to claim 10 in which said sound-deflecting walls members are of rigid material and are disposed upright and one of the transverse wall members is a flat base wall so that the panel can rest thereon and form a free-standing partition.

* * * * *

UNITED STATES PATENT OFFICE

CERTIFICATE OF CORRECTION

Patent No. 4,094,379 Dated June 13, 1978

Inventor(s) David I. Steinberger

It is certified that error appears in the above-identified patent and that said Letters Patent are hereby corrected as shown below:

Column 4: cancel the paragraph at lines 31 to 42.

Column 8: line 30, correct the spelling of "diaphanous".

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*